US012458075B2

(12) United States Patent
Hewett et al.

(10) Patent No.: US 12,458,075 B2
(45) Date of Patent: Nov. 4, 2025

(54) MALE GARMENT WITH SUPPORT ELEMENT

(71) Applicant: Nut Huggers Apparel Inc., Edmond, OK (US)

(72) Inventors: Jarrad Hewett, Edmond, OK (US); Logan Wehling, Edmond, OK (US)

(73) Assignee: Nut Huggers Apparel Inc., Edmond, OK (US)

( * ) Notice: Subject to any disclaimer, the term of this patent is extended or adjusted under 35 U.S.C. 154(b) by 0 days.

(21) Appl. No.: 18/622,386

(22) Filed: Mar. 29, 2024

(65) Prior Publication Data

US 2025/0302121 A1 Oct. 2, 2025

(51) Int. Cl.
*A41B 9/00* (2006.01)
*A41B 9/02* (2006.01)

(52) U.S. Cl.
CPC ..... *A41B 9/004* (2013.01); *A41B 9/02* (2013.01); *A41B 9/023* (2013.01)

(58) Field of Classification Search
CPC ..... A41B 9/02; A41B 9/023; A41B 9/004
See application file for complete search history.

(56) References Cited

U.S. PATENT DOCUMENTS

| | | | | |
|---|---|---|---|---|
| 2,055,973 | A * | 9/1936 | Goss | A41B 9/12 2/407 |
| 7,958,571 | B2 * | 6/2011 | Kitsch | A41B 9/023 2/403 |
| D809,242 | S | 2/2018 | Kimel et al. | |
| D810,398 | S | 2/2018 | Kimel et al. | |
| 9,907,342 | B2 | 3/2018 | Fisher | |
| D894,530 | S | 9/2020 | Perry et al. | |
| 10,905,170 | B2 * | 2/2021 | Fortier | A41B 9/026 |
| D913,632 | S | 3/2021 | Franco et al. | |
| 10,980,289 | B2 * | 4/2021 | Ng | A41B 9/023 |
| 11,553,737 | B1 * | 1/2023 | Hong | A41B 9/023 |
| 11,653,705 | B2 * | 5/2023 | McCombs | A41B 9/023 2/403 |
| D988,636 | S * | 6/2023 | Lecigne | D2/712 |
| D1,007,813 | S | 12/2023 | Perry et al. | |
| 11,918,057 | B1 * | 3/2024 | Charbonnet | G21F 3/02 |
| 2007/0245463 | A1 * | 10/2007 | Kang | A41B 9/023 2/403 |
| 2011/0258756 | A1 * | 10/2011 | Avgustopulo | A41B 9/02 2/403 |

(Continued)

FOREIGN PATENT DOCUMENTS

| | | | |
|---|---|---|---|
| DE | 202020000556 U1 * | 5/2020 | |
| FR | 2624701 B1 | 11/1991 | |

(Continued)

*Primary Examiner* — F Griffin Hall
(74) *Attorney, Agent, or Firm* — Dunlap Codding, P.C.

(57) ABSTRACT

A male garment is designed with a support element for supporting the wearer's genitals. In one aspect, the support system is disposed within a garment body that includes a waistband, a front panel secured at the waistband, a rear panel secured at the waistband and positioned opposite the front panel, and a gusset extending between the front panel and the rear panel. The support system includes a front support piece positioned against the front panel and first and second side supports that extend from the waistband, along the front support piece, and beyond the gusset.

12 Claims, 8 Drawing Sheets

(56) References Cited

U.S. PATENT DOCUMENTS

| | | | | |
|---|---|---|---|---|
| 2014/0331390 | A1* | 11/2014 | Matsumoto | A41B 9/023 2/403 |
| 2019/0090552 | A1 | 3/2019 | Crump | |
| 2019/0124999 | A1 | 5/2019 | Crump | |
| 2019/0191784 | A1 | 6/2019 | Crump | |
| 2020/0060353 | A1 | 2/2020 | Crump | |
| 2020/0297041 | A1 | 9/2020 | Crump | |
| 2022/0408847 | A1* | 12/2022 | Mendoza | A41B 9/023 |
| 2024/0148080 | A1* | 5/2024 | Baek | A41B 9/023 |
| 2024/0407474 | A1* | 12/2024 | Drouin | A41D 27/28 |

FOREIGN PATENT DOCUMENTS

| | | | |
|---|---|---|---|
| JP | 3942867 | B2 | 4/2007 |
| KR | 20-0165951 | Y1 | 2/2000 |
| KR | 10-2016-0031087 | A | 3/2016 |
| KR | 10-1977246 | B1 | 5/2019 |
| KR | 20-2021-0001338 | U | 6/2021 |
| KR | 10-2022-0076726 | A | 6/2022 |
| WO | 2022220381 | A1 | 10/2022 |

* cited by examiner

MALE GARMENT WITH SUPPORT ELEMENT

FIELD OF THE INVENTION

The present invention is related to garments, and more particularly to a male garment with a support element for supporting the wearer's genitals.

BACKGROUND OF THE INVENTION

The garment industry continues to wrestle with the complications involved in designing male underwear that is suitable for both support and comfort. Various designs have been proposed to meet these challenges. The first category of male underwear design focuses on providing a tight and secure fit—and, in some designs, an accentuating lift—for the male wearer's genitals. These compression designs often cause discomfort for the wearer by creating pressure on the groin and retaining perspiration. Other underwear designs lean toward accommodating the wearer's genitals with a loose fit. These designs, while more breathable, permit undesirable movement of both the genitals and the garment fabric, which can bunch and promote chafing about the thighs.

To alleviate these concerns, several pouch-based underwear systems have been developed with a frontward oriented pouch to lift and hold the wearer's genitals within the undergarment. One problem with these load-bearing pouch systems is that the weight distribution can create unwanted pressure and pull the front of the underwear downward, causing the genitals to become dislodged from the pouch. Displacement is particularly likely with pouches that are positioned lower within the garment to maintain a more natural placement for the wearer's genitals. For pouches that are higher within the garment, displacement is less likely, but the wearer's genitals are subjected to an unnatural orientation.

Although these prior art designs have taken steps in improving garment practicality for men, there remain opportunities to optimize the production and function of these male garments. It is to these and other deficiencies in the prior art that the present embodiments are directed.

SUMMARY OF THE INVENTION

In some embodiments, the present disclosure is directed to a male garment having a garment body and a support system disposed within the garment body. The garment body includes a waistband, a front panel secured at the waistband, a rear panel secured at the waistband, where the rear panel is positioned opposite the front panel, and a gusset extending between the front panel and the rear panel. The support system includes a front support piece that is positioned against the front panel, a first side support, and a second side support opposite the first side support. Each of the first and second side supports extends from the waistband, along the front support piece, and beyond the gusset.

In other embodiments, a male garment is disclosed for supporting a wearer's genitals. The male garment includes a garment body having a waistband, a front panel secured at the waistband, and a rear panel secured at the waistband opposite the front panel. The male garment further includes a support system disposed within the garment body, where the support system includes a first side support and a second side support opposite the first side support. Each of the first and second side supports includes a blunt end secured along the waistband and a tapered end that terminates at a height between that of the wearer's anus and the waistband.

In yet other embodiments, a male garment is disclosed having a garment body and a support system disposed within the garment body. The garment body includes a waistband, a front panel secured at the waistband, a rear panel secured at the waistband opposite the front panel, and a gusset extending between the front panel and the rear panel. The garment body further includes a first leg having a first outer leg panel and a first inner leg panel that form a first leg opening. A second leg of the garment body has a second outer leg panel and a second inner leg panel that form a second leg opening. Turning to the support system, a first side support is positioned opposite a second side support, and each of the first and second side supports extends beyond the gusset.

WRITTEN DESCRIPTION

Figure 1A:
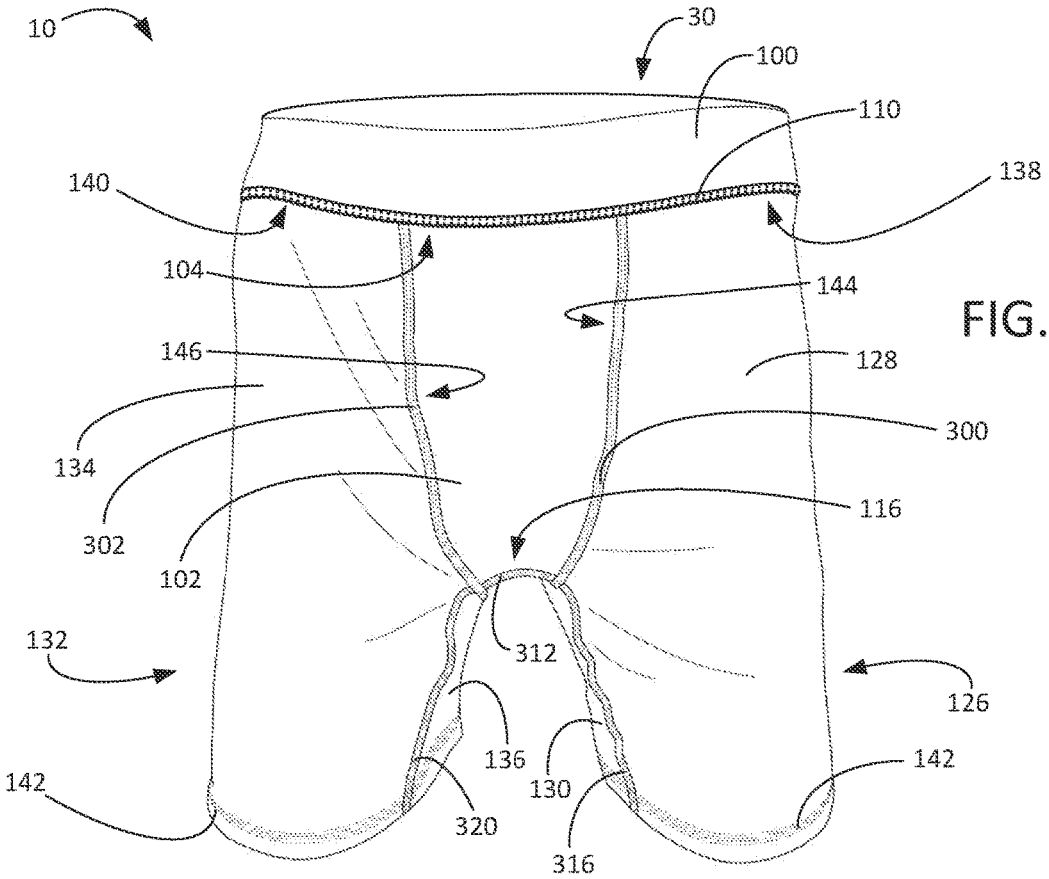
FIG. 1A presents a front view of a male garment constructed in accordance with an exemplary embodiment.

In exemplary applications, a male garment 10 provides a support system 20 for securing male genitals in a natural placement. More particularly, the male garment 10 includes a garment body 30 with the support system 20 disposed therein. Although FIGS. 1 through 10 depict the male garment 10 as a pair of boxer briefs, it will be appreciated that the disclosed support system 20 is particularly well suited for use in undergarments including, but not limited to, boxers, briefs, midway briefs, trunks, hip shorts, tights, and long underwear. The support system 20 is further well suited for use in garments such as swimwear, activewear, shorts, and pants.

As illustrated in FIGS. 1 through 4, the garment body 30 of the male garment 10 includes a waistband 100, a front panel 102 having an upper end 104 secured at the waistband 100, and a rear panel 106 positioned opposite the front panel 102, where an upper end 108 of the rear panel 106 is also secured at the waistband 100. The waistband 100 is elastic and configured to wrap around a wearer's torso (e.g., at the hips, above the hips, or below the hips). As depicted, the waistband 100 is sewn at an upper end of the outward side of the garment body 30 using a waistband seam 110. It will be appreciated, however, that the waistband 100 may alternatively be secured to the inside of the garment body 30 or encased between two or more layers of fabric. In various embodiments, the waistband 100 is a solid color, patterned, logoed, or otherwise ornamented. The front panel 102 generally covers the hypogastric (pubic) region of the wearer's abdomen and is narrower than the rear panel 106, which extends across the wearer's buttocks. A gusset 112 extends between the front panel 102 and the rear panel 106 across the perineal region (i.e., between the wearer's scrotum and anus). More particularly, a front end 114 of the gusset 112 is attached to a lower end 116 of the front panel 102, and, accordingly, the front end 114 of the gusset 112 and the lower end 116 of the front panel 102 have approximately the same length. Opposite the front end 114 of the gusset 112, a rear end 118 is attached to a lower end 120 of the rear panel 106, which has approximately the same length as the rear end 118 of the gusset 112.

The garment body 30 further includes a first (left side, with respect to the wearer's perspective) leg opening 122 and a second (right side, with respect to the wearer's perspective) leg opening 124. As depicted in FIGS. 1 through 4, the first leg opening 122 is disposed at the end of a first leg 126 that is formed by a first outer leg panel 128 in connection with a first inner leg panel 130. The second leg opening 124 is similarly disposed at the end of a second leg 132 formed from a second outer leg panel 134 and a second inner leg panel 136. The first outer leg panel 128 and the second outer leg panel 134 are positioned at opposite sides of the garment body 30 and are each secured by an upper end 138, 140 at the waistband 100. Each of the first leg 126 and the second leg 132 has a leg hem 142 proximate to the first and second leg openings 122, 124. Optionally, the leg hem 142 incorporates an elastic. Depending on the type of male garment 10, the first leg 126 and the second leg 132 may be longer or shorter than depicted in FIGS. 1 through 4. It will be appreciated that some embodiments omit the inner leg panel (e.g., when the male garment 10 is briefs); in such embodiments, the first leg opening 122 is formed by connecting the first outer leg panel 128 and the gusset 112, while the second leg opening 124 is formed when the second outer leg panel 134 and the gusset 112 are connected.

It will be appreciated that suitable materials for the garment body 30 include, but are not necessarily limited to, polyester, elastane, cotton knit, nylon, microfiber, wool (e.g., merino), bamboo, micromodal, silk, viscose, and blends of the same. In one embodiment, the garment body 30 is constructed from a 90% polyester, 10% elastane blend. In another embodiment, the garment body 30 is constructed using a 95% cotton, 5% polyester blend. In various embodiments, the garment body 30 is a solid color, patterned, logoed, or otherwise ornamented.

Within the garment body 30, the support system 20 is positioned for direct contact with the wearer's genitals. More particularly, the support system 20 is configured to provide lift to the wearer's penis while offering easy access and removal for urination. The support system 20 also cradles the wearer's scrotum and prevents contact with the thighs and chafing. Further, the support system 20 helps to elevate the wearer's buttocks.

The support system 20 includes a front support piece 200, a first side support 202, and a second side support 204 opposite from the first side support 202. Suitable materials for the front support piece 200 and the first and second side supports 202, 204 include, but are not necessarily limited to, polyester, elastane nylon, bamboo, micromodal, wool, and blends of the same. In one embodiment, the front support piece 200 and the first and second side supports 202, 204 are each constructed from a mesh material that provides breathability, temperature control, and moisture wicking, such as a polyester-elastane mesh blend.

The front support piece 200 is positioned against the front panel 102 of the garment body 30 and, in general, has the same dimensions as the front panel 102. The front support piece 200 has a generally straight upper edge 206 that is secured at the waistband 100, a first side edge 208 that is secured along a first side edge 144 of the front panel 102, a second side edge 210 that is secured along a second side edge 146 of the front panel 102, and a lower edge 212 secured at the lower end of the front panel 102. The front support piece 200 aids in comfort by reducing urethra rub against the garment body 30 and promoting breathability. In some embodiments, the front support piece 200 is omitted.

Figure 1B:
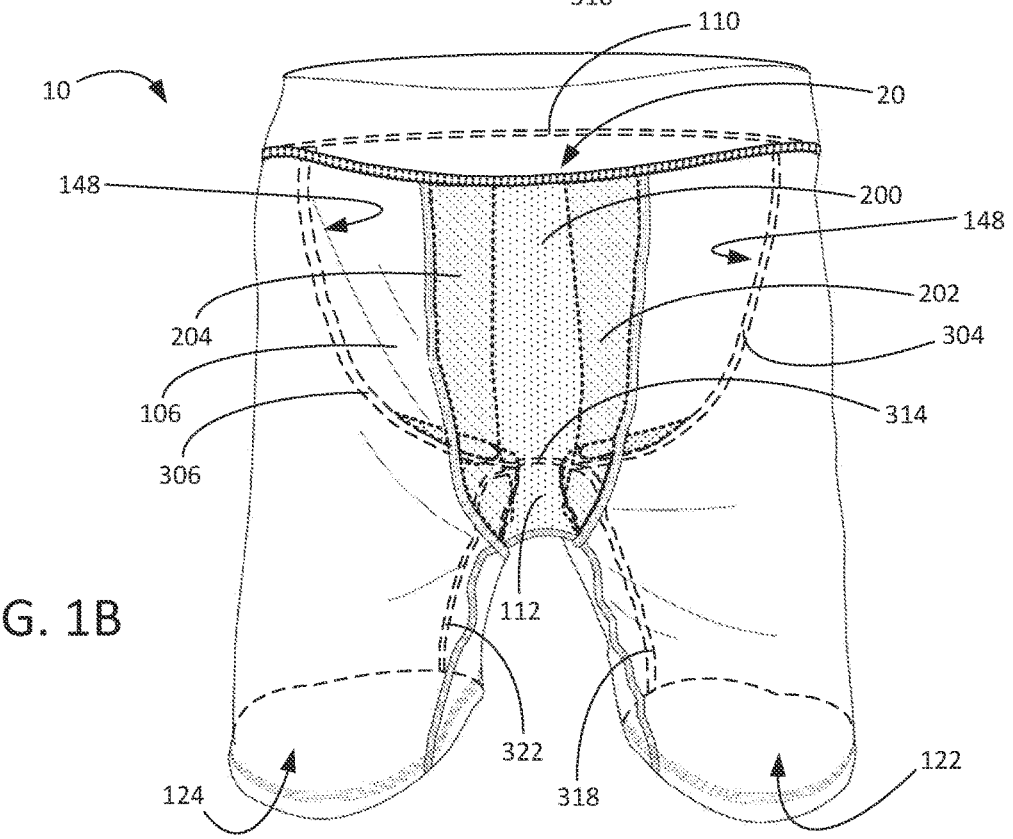
FIG. 1B presents a partial cutaway view of the male garment of FIG. 1A.
Figure 2A:
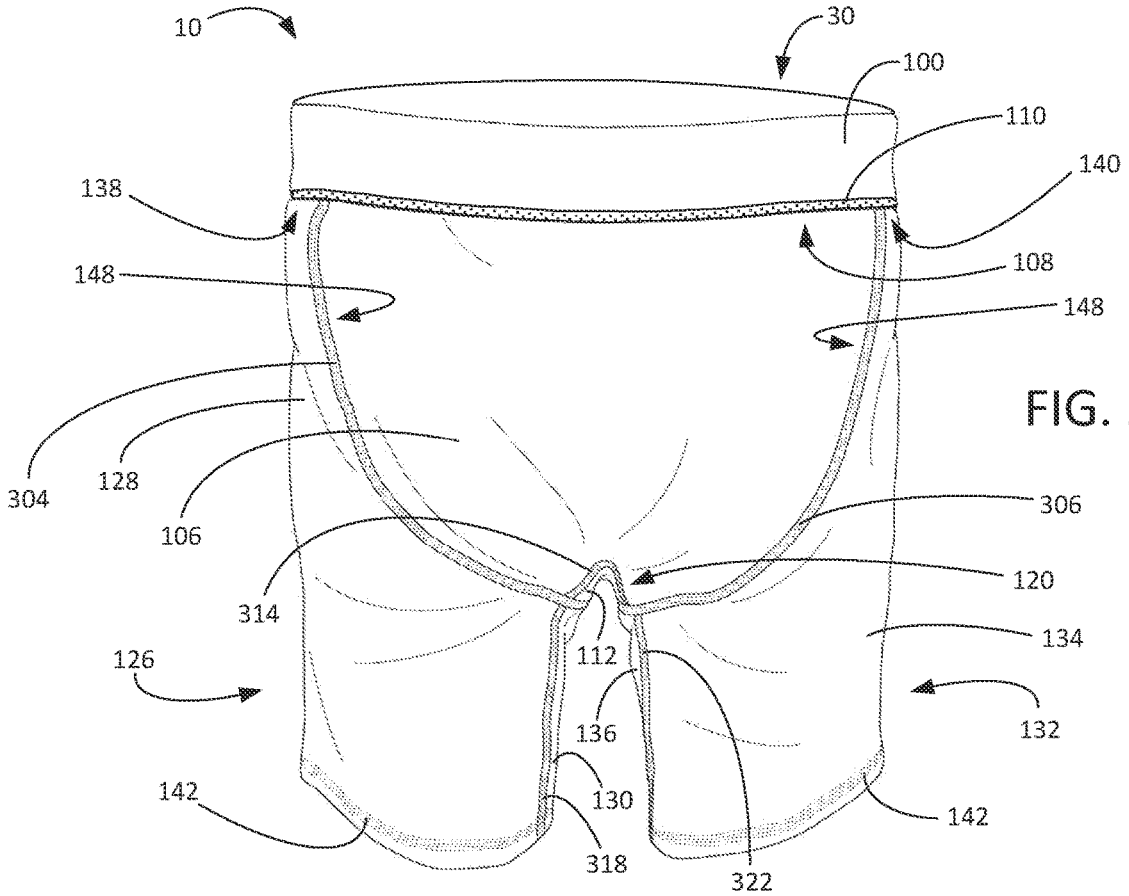
FIG. 2A presents a rear view of the male garment of FIG. 1.
Figure 2B:
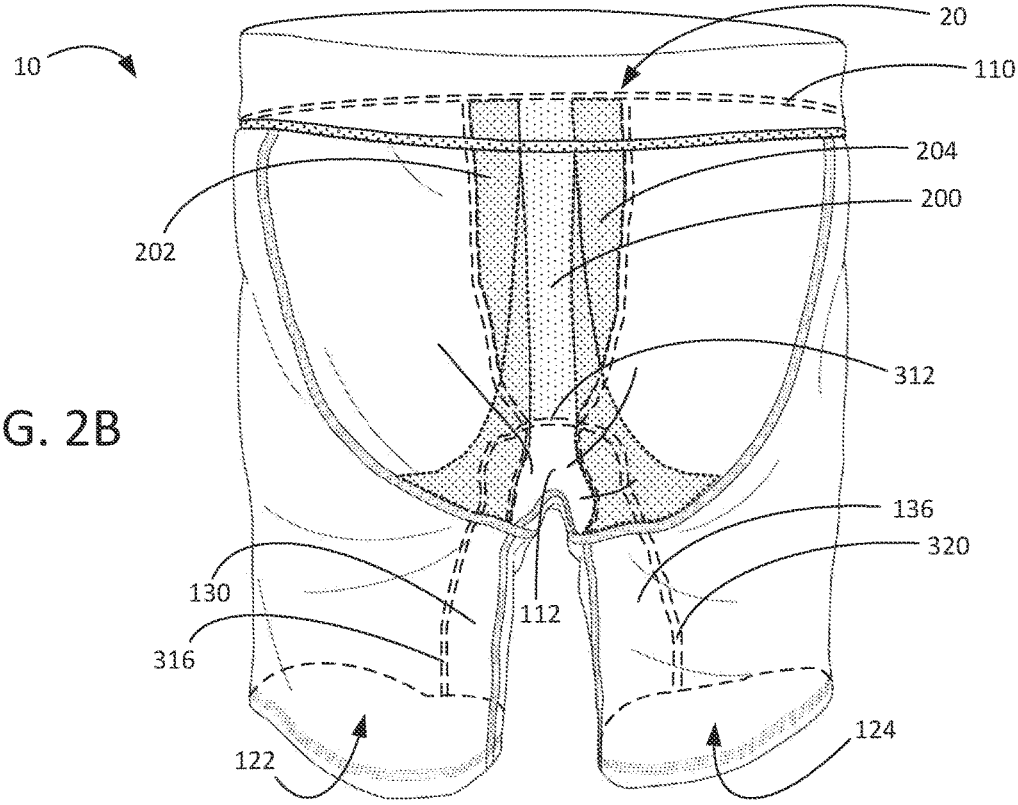
FIG. 2B presents a partial cutaway view of the male garment of FIG. 2A.
Figure 3A:
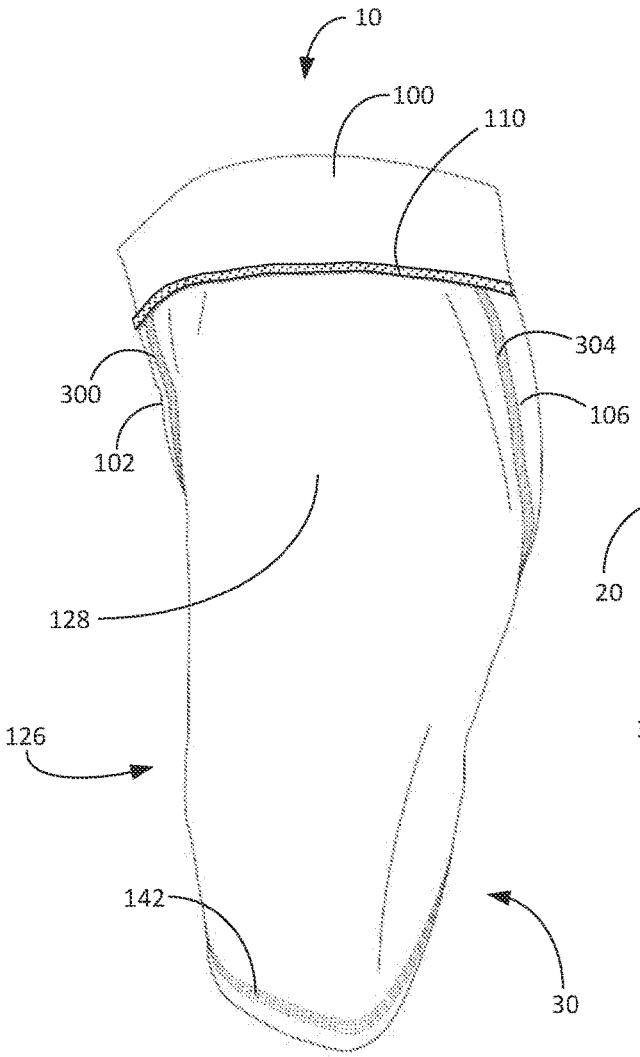
FIG. 3A presents a left side view of the male garment in FIG. 1.
Figure 3B:
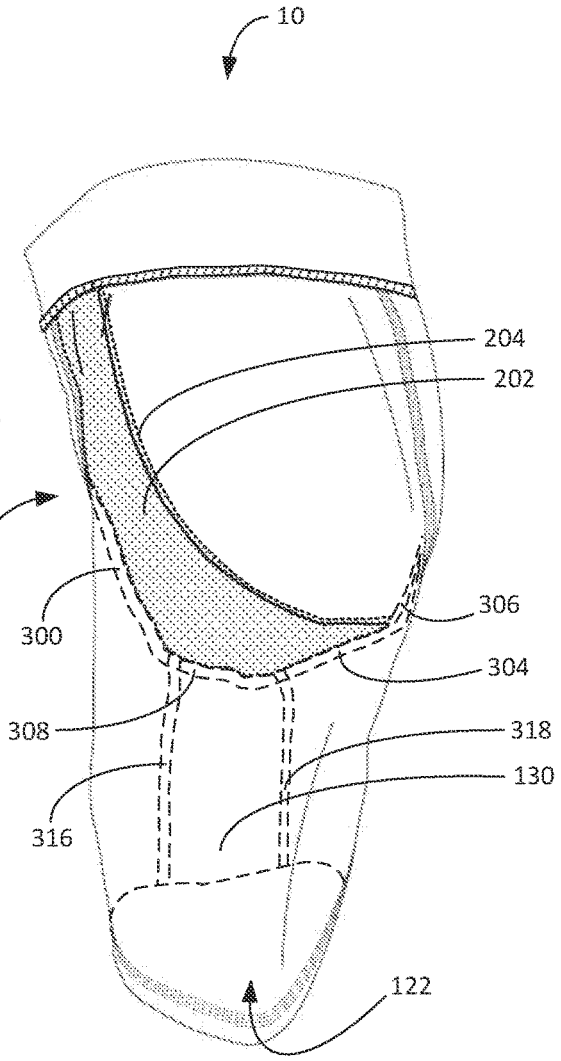
FIG. 3B presents a partial cutaway view of the male garment of FIG. 3A.
Figure 4A:
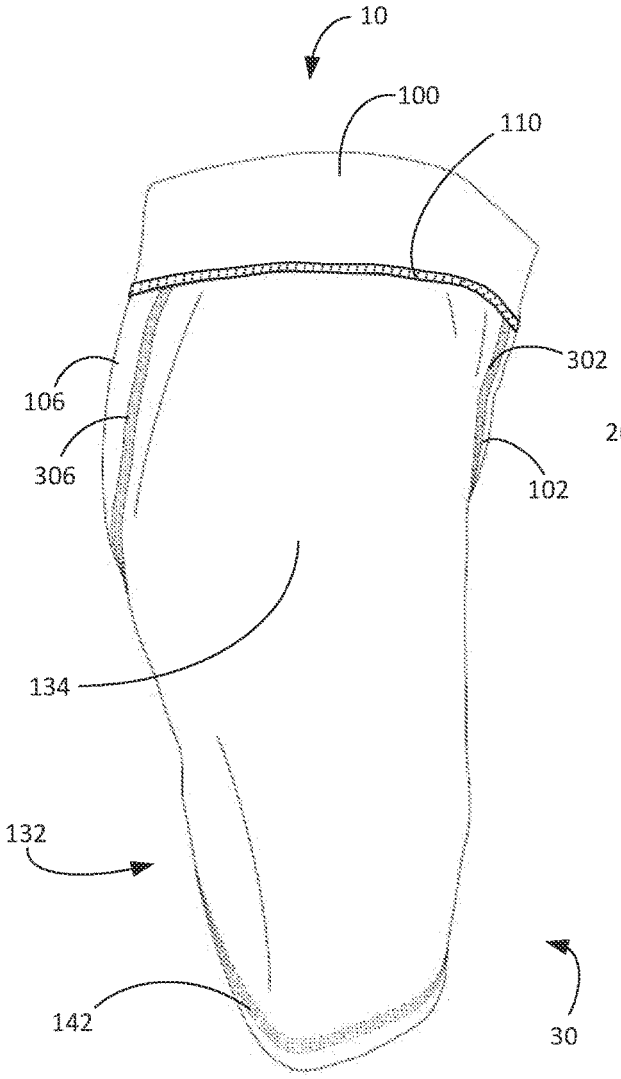
FIG. 4A presents a right side view of the male garment in FIG. 1.
Figure 4B:
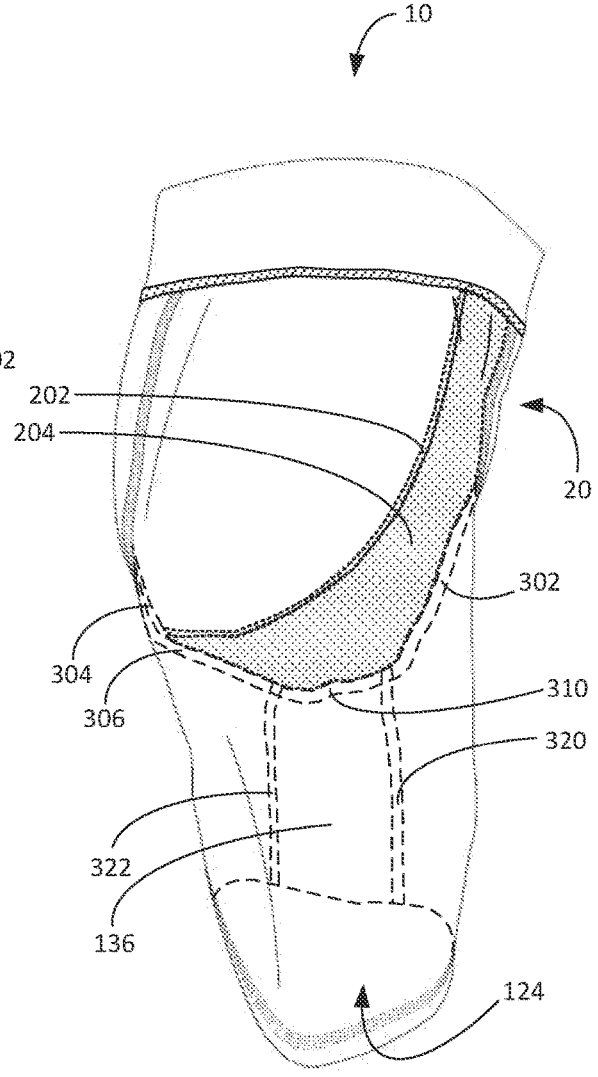
FIG. 4B present a partial cutaway view of the male garment of FIG. 4A.
Figures 5, 6A, 6B:
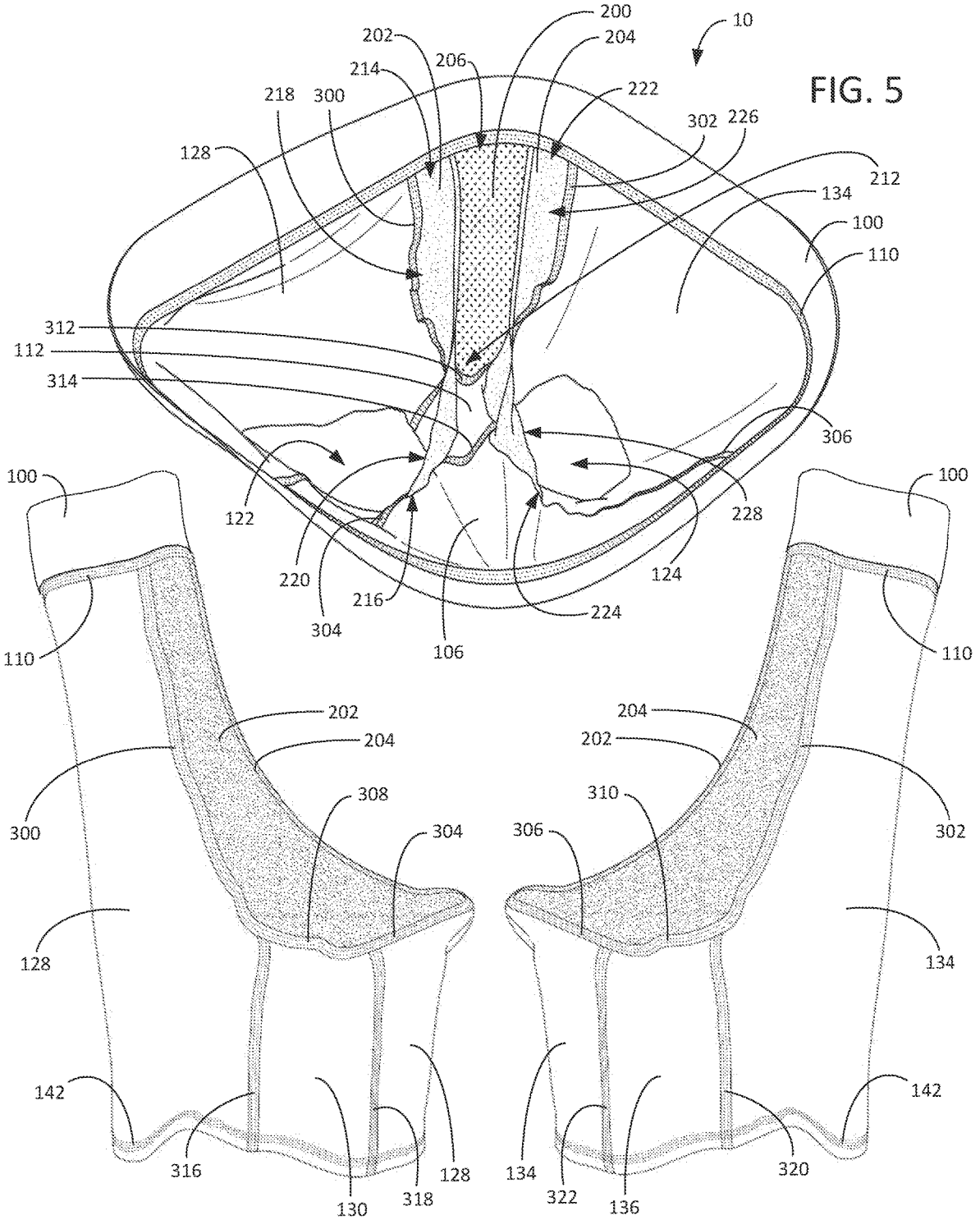
FIG. 5 presents a top view of the male garment of FIG. 1.
FIG. 6A presents a close-up left side view of the support system within the male garment of FIG. 1, where the male garment has been turned inside out.
FIG. 6B presents a close-up right side view of the support system within the male garment of FIG. 1, where the male garment has been turned inside out.

As shown in FIG. 5, the first and second side supports 202, 204 are secured at either side of the front support piece 200 and/or the front panel 102. Each of the first and second side supports 202, 204 extends from the waistband 100, along the first and second side edges 208, 210 of the front support piece 200—and/or the first and second side edges 144, 146 of the front panel 102—and beyond the rear end 118 of the gusset 112. The first side support 202 includes a squared-off, blunt end 214 that is sewn flat along the waistband 100 and a portion of the upper edge 206 of the front support piece 200 and/or the front panel 102. Opposite from the blunt end 214, the first side support 202 includes a tapered end 216 that extends beyond the rear end 118 of the gusset 112 and terminates at a height between that of the wearer's anus and the waistband 100. By extending beyond the gusset 112 of the garment body 30, the first side support 202 offers additional buttocks support to the wearer, in addition to genital support. In one embodiment, the tapered end 216 is pointed at its furthest tip. FIGS. 1B and 2B illustrate the tapered end 216 extending along a curved side edge 148 of the rear panel 106. In another embodiment, the tapered end 216 instead extends along the interior face of the rear panel 106. Between the blunt end 214 and the tapered end 216, the first side support 202 includes a lower curved edge 218 that is secured to the garment body 30 and an upper curved edge 220 opposite the lower curved edge 218. As best illustrated in FIGS. 3B, 4B, and 6, the upper curved edge 220 is generally configured to match the curve of the wearer's lower torso and lower buttocks.

Figure 7:
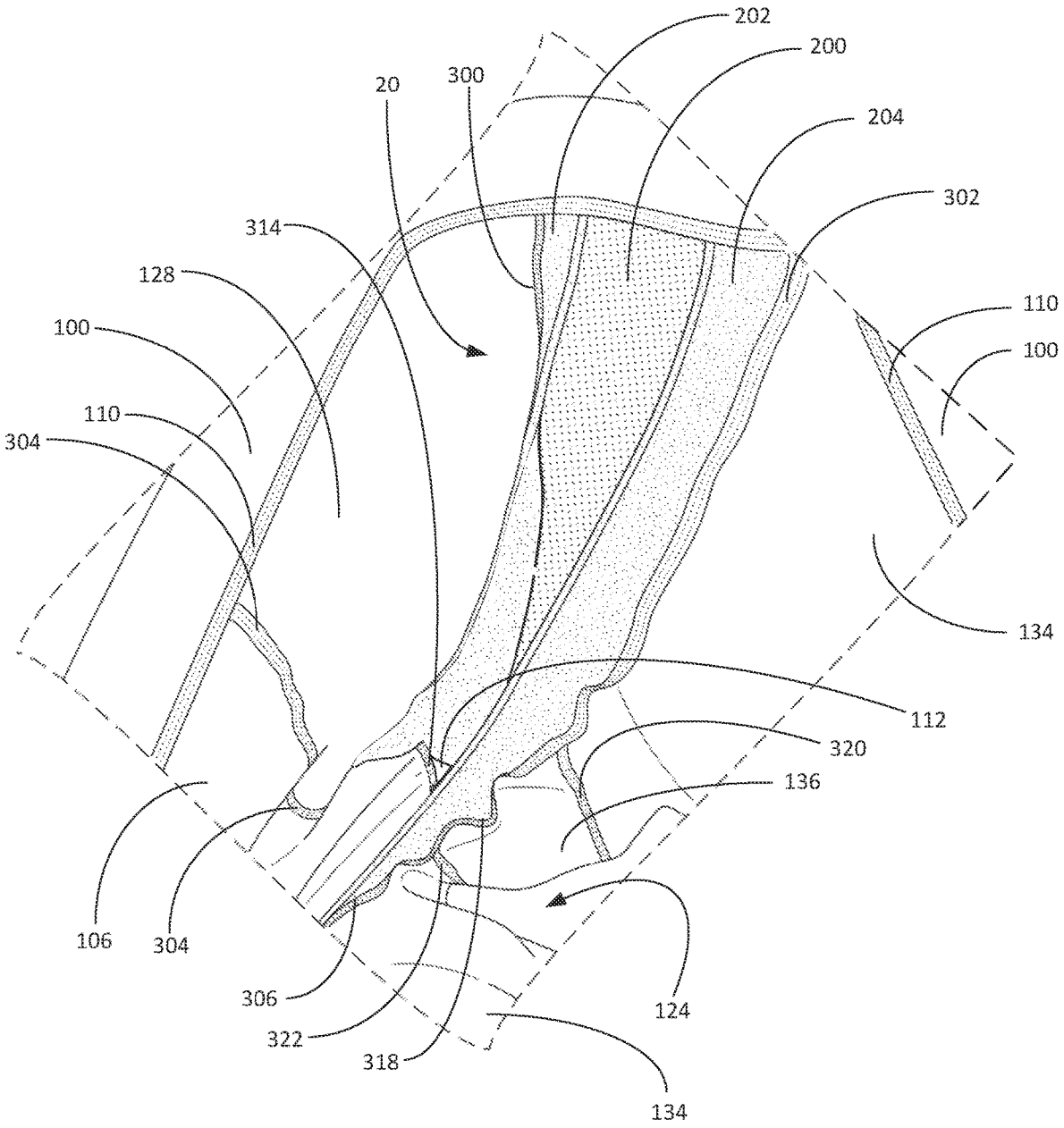
FIG. 7 presents a top perspective view of the support system of FIG. 1.
Figure 8:
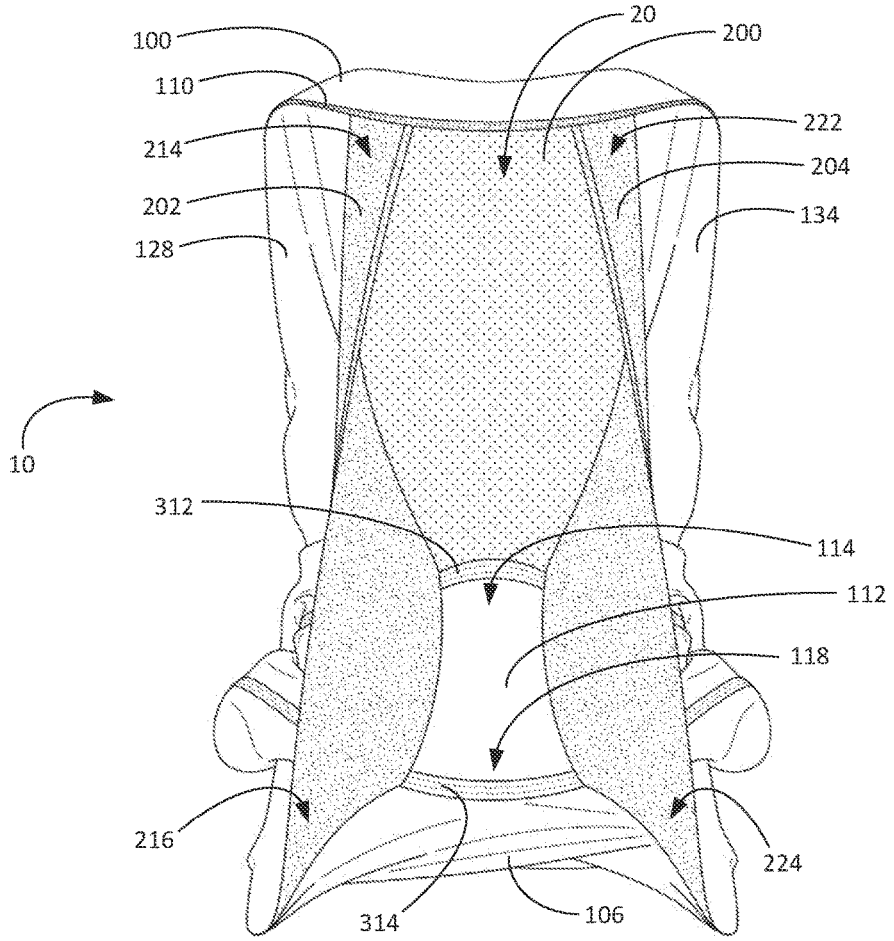
FIG. 8 presents a close-up top view of a support system within the male garment of FIG. 1, where the male garment has been folded underneath.
Figure 9:
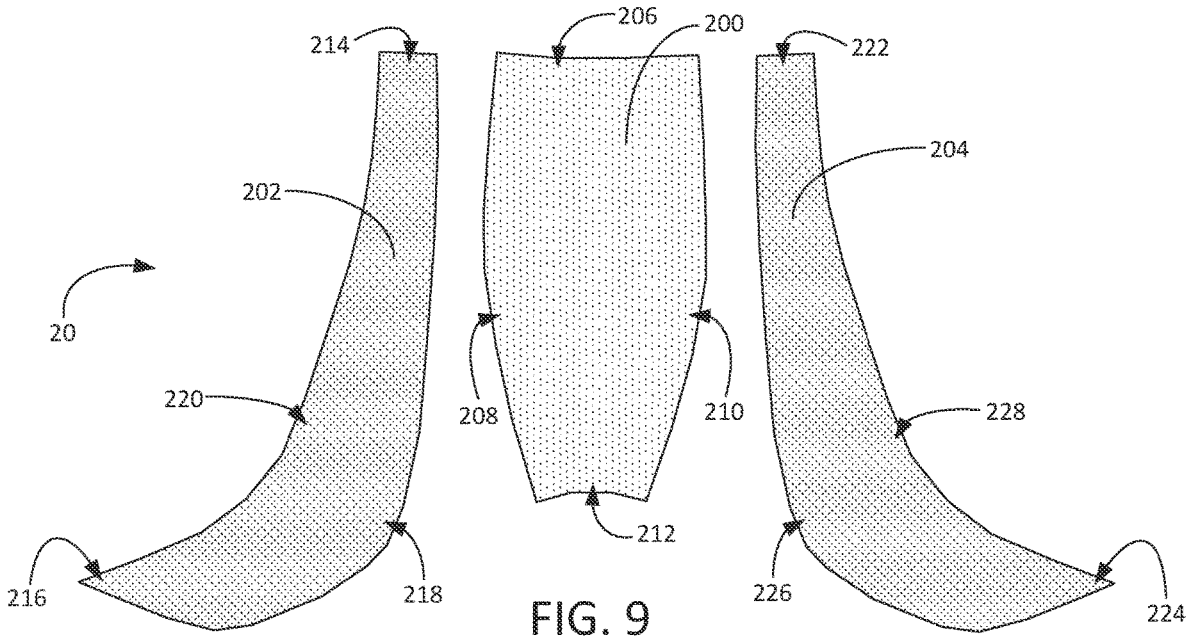
FIG. 9 presents an exploded view of the support system of FIG. 8.

As illustrated in FIG. 9, the structure of the second side support 204 mirrors that of the first side support 202, with a blunt end 222, a tapered end 224, a lower curved edge 226, and an upper curved edge 228. The blunt end 222 of the second side support 204 is sewn flat along a different portion of the waistband 100 and the upper edge 206 of the front support piece 200 and/or the front panel 102, such that the blunt end 214 of the first side support 202 does not contact the blunt end 222 of the second side support 204. FIGS. 5 and 7 illustrate this separation of the blunt ends 214, 222, which permits the wearer to easily remove the penis for urination without substantially lowering the male garment 10. In one embodiment, the blunt ends 214, 222 of the first and second side supports 202, 204 are secured at the waistband 100 by the waistband seam 110, which may also secure the upper edge 206 of the front support piece 200 to the upper end 104 of the front panel 102. The first and second side supports 202, 204 are generally tensioned by the weight of the wearer's scrotum when the male garment 10 is worn. In various embodiments, and as best illustrated by FIGS. 2B, 5, and 8, the first side support 202 and the second side support 204 are angled towards each other proximate to the blunt ends 214, 222 and are approximately parallel or angled away from each other proximate to the tapered ends 216, 224. This angled configuration toward the front of the male garment 10 provides greater security for the genitals during physical activity by cradling the scrotum. The angled support system 20 also protects the scrotum from direct contact with the wearer's thighs to minimize discomfort associated therewith.

FIGS. 1 through 10 generally depict the proportions for an embodiment of the male garment 10 in size XL (waist 40"-42"). As the size of the garment body 30 changes to accommodate the wearer, the dimensions of the first side support 202 and the second side support 204 remain relatively unchanged. Accordingly, the proportions of the first and second side supports 202, 204 in comparison to the garment body 30 will vary based on garment size. For example, for an embodiment of the male garment 10 in size S (waist 28"-30"), the tapered ends 216, 224 of the first and second side supports 202, 204 may extend to a height further above the wearer's anus than in the size XL embodiment.

The male garment 10 is constructed by securing various portions of the garment body 30 and the support system 20 together, e.g., using rows of stitching. In the embodiment depicted in FIGS. 1 through 10, a first front garment seam 300 is used to secure the first outer leg panel 128 and the front panel 102 of the garment body 30 with the front support piece 200 and the first side support 202 of the support system 20. Similarly, a second front garment seam 302 secures the second outer leg panel 134 and the front panel 102 with the front support piece 200 and the second side support 204 of the support system 20. Turning to the other side of the male garment 10, a first rear garment seam 304 is used to secure the first outer leg panel 128 and the rear panel 106 of the garment body 30 with the first side support 202, while a second rear garment seam 306 secures the second outer leg panel 134 and the rear panel 106 with the second side support 204.

Figure 10:
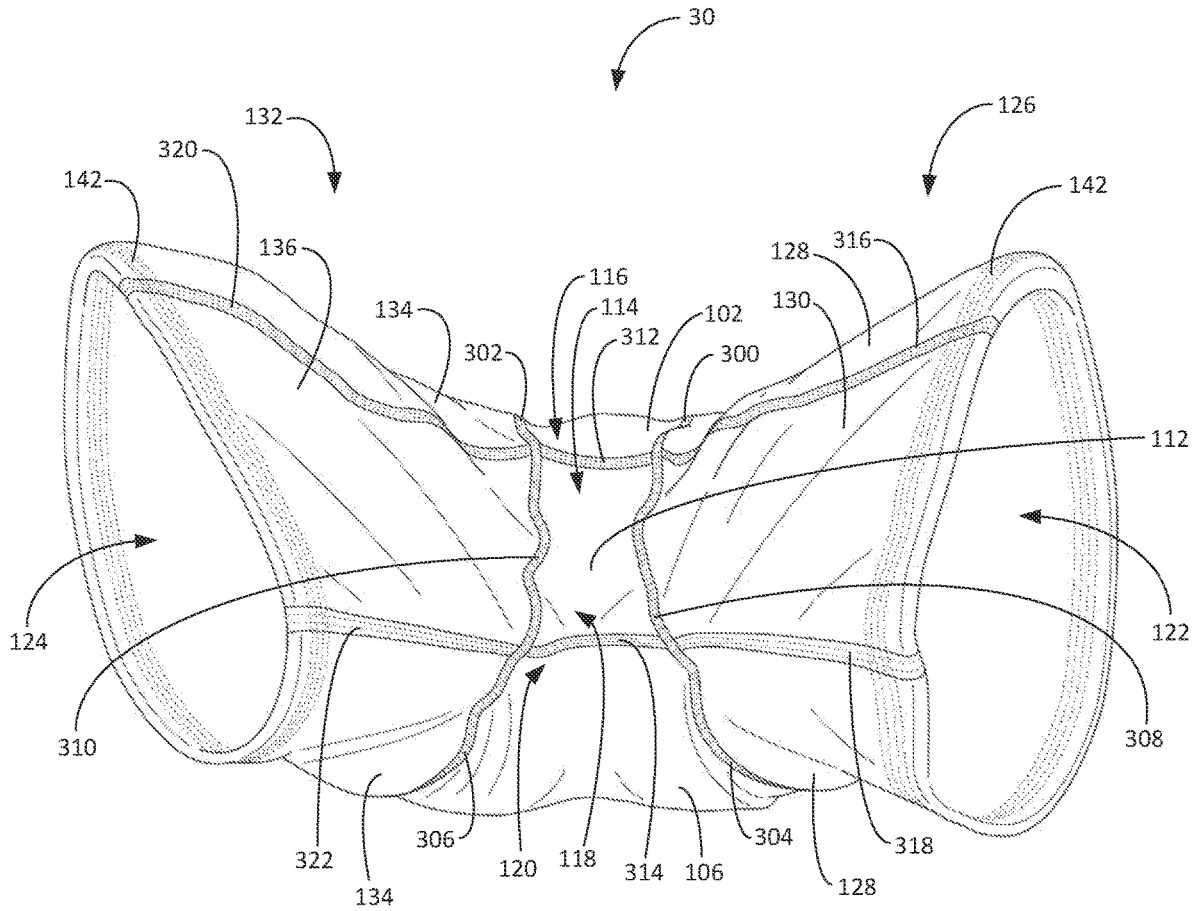
FIG. 10 presents a bottom view of the male garment of FIG. 1.

The first side support 202 is further secured to the first inner leg panel 130 and the gusset 112 of the garment body 30 using a first gusset edge seam 308. A second gusset edge seam 310 secures the second side support 204 with the second inner leg panel 136 and the gusset 112. In the depicted non-limiting embodiment, and as best shown at FIG. 10, the first front garment seam 300, the first gusset edge seam 308, and the first rear garment seam 304 are connected as a continuous row of stitches. At the other side of the male garment 10, the second front garment seam 302, the second gusset edge, and the second rear garment seam 306 are similarly connected as a unitary row of stitches.

Approximately perpendicular to the first and second gusset edge seam 308, 310, a front crotch seam 312 is used to secure the front support piece 200 with the front panel 102 and the gusset 112, and a rear crotch seam 314 secures the rear panel 106 with the gusset 112.

Turning to the legs 126, 132 of the male garment 10, a first front leg seam 316 and a first rear leg seam 318 are used at opposite sides of the first inner leg panel 130 to secure the same with the first outer leg panel 128. A second front leg seam 320 and a second rear leg seam 322 similarly secure the second inner leg panel 136 and the second outer leg panel 134. As depicted in FIG. 10, in some embodiments, the first and second front leg seam 316, 320 are connected at either end of the front crotch seams 312 to form a unitary row of stitches. The rear crotch seam 314 similarly connects the first and second rear leg seams 318, 322 to form one continuous row of stitches.

Although reference is made throughout this application to stitching and seams, it will be appreciated that the portions of the male garment 10 may be fused to each other and to portions of the support system 20 using other techniques than sewing. Alternative materials for joining portions of the male garment 10 and of the support system 20 include, without limitation, fabric-compatible glues and other adhesives.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein.

It is claimed:

1. A male garment for supporting a wearer's genitals, the male garment comprising:
- a garment body comprising
  - a waistband;
  - a front panel secured at the waistband;
  - a rear panel secured at the waistband and positioned opposite the front panel; and
  - a gusset extending between the front panel and the rear panel; and
- a support system disposed within the garment body, the support system comprising:
  - a front support piece positioned against the front panel;
  - a first side support; and
  - a second side support separate and spaced from the first side support,
  - wherein each of the first and second side supports comprises:
    - a blunt end;
    - a tapered end opposite the blunt end;
    - an upper curved edge extending from the blunt end to the tapered end; and
    - a lower curved edge opposite the upper curved edge extending from the blunt end to the tapered end,
    - wherein the blunt end is secured to the waistband, the lower curved edge is secured to the front panel, the gusset, and the rear panel, and the upper curved edge is a free edge unattached to the garment body, such that the tapered end is extendible perpendicularly from the rear panel, and
    - wherein the upper curved edge and the lower curved edge converge to a point.

2. The male garment of claim 1, wherein the front support piece has the same dimensions as the front panel.

3. The male garment of claim 1, wherein the first side support, the second side support, and the front support piece are constructed from the same material.

4. The male garment of claim 1, wherein the garment body further comprises:
- a first outer leg panel secured at the waistband;

a first inner leg panel secured to the first outer leg panel to form a first leg opening;

a second outer leg panel secured at the waistband and positioned opposite the first outer leg panel; and a second inner leg panel secured to the second outer leg panel to form a second leg opening.

5. The male garment of claim 4, further comprising:

a first front garment seam that secures the first outer leg panel with the front panel, the front support piece, and the first side support; and a second front garment seam that secures the second outer leg panel with the front panel, the front support piece, and the second side support.

6. The male garment of claim 5, further comprising:

a first rear garment seam that secures the first outer leg panel with the rear panel and the first side support; and a second rear garment seam that secures the second outer leg panel with the rear panel and the second side support.

7. The male garment of claim 6, further comprising:

a first gusset edge seam that secures the first inner leg panel with the gusset and the first side support; and a second gusset edge seam that secures the second inner leg panel with the gusset and the second side support.

8. The male garment of claim 7, wherein the first front garment seam, the first gusset edge seam, and the first rear garment seam are a continuous row of stitches, wherein the second front garment seam, the second gusset edge seam, and the second rear garment seam are a continuous row of stitches.

9. The male garment of claim 4, further comprising:

a front crotch seam that secures the front support piece with the front panel and the gusset; and a rear crotch seam that secures the rear panel with the gusset.

10. The male garment of claim 9, further comprising:

a first front leg seam and a first rear leg seam that both secure the first inner leg panel with the first outer leg panel;

a second front leg seam and a second rear leg seam that both secure the second inner leg panel and the second outer leg panel.

11. The male garment of claim 10, wherein the front crotch seam connects the first and second front leg seams as a continuous row of stitches, wherein the rear crotch seam connects the first and second rear leg seams as a continuous row of stitches.

12. The male garment of claim 1, wherein the first side support and the second side support are angled towards each other proximate to the blunt ends and angled away from each other proximate to the tapered ends.

* * * * *